United States Patent [19]

Stoll

[11] 3,946,580

[45] Mar. 30, 1976

[54] WASHING MACHINE DRUM SHAVING ROTARY FEED WORM

[75] Inventor: Karl-Heinz A. Stoll, Sprendlingen, Germany

[73] Assignee: Vosswerke GmbH, Sarstedt, Germany

[22] Filed: Mar. 25, 1971

[21] Appl. No.: 128,066

[52] U.S. Cl. ..... 68/145

[51] Int. Cl.[2] ..... D06F 37/08

[58] Field of Search ..... 68/58, 139, 143, 145, 146, 68/142, 144; 69/30; 34/109; 259/2, 3, 13, 14, 29, 30, 75, 81 R, 175, 176, 177 R

[56] References Cited

UNITED STATES PATENTS

| | | | |
|---|---|---|---|
| 2,056,803 | 10/1936 | Failing | 68/58 UX |
| 2,437,169 | 3/1948 | Miller | 68/58 |
| 2,978,229 | 4/1961 | Jackson | 68/58 X |
| 3,103,802 | 9/1963 | Streich | 68/58 X |
| 3,608,338 | 9/1971 | Lutzen | 68/145 |

*Primary Examiner*—Daniel Blum
*Assistant Examiner*—Philip R. Coe
*Attorney, Agent, or Firm*—Mason, Mason & Albright

[57] ABSTRACT

A washing machine drum which is divided into axially arranged compartments has an internal feed worm rigid with the drum casing. A support shaft of the drum serves to deliver water and soap or detergent to the compartments.

4 Claims, 2 Drawing Figures

INVENTOR
KARL-HEINZ ALEXANDER STOLL
BY
Mason, Mason & Albright
ATTORNEYS

WASHING MACHINE DRUMSHAVING ROTARY FEED WORM

BACKGROUND OF THE INVENTION

1. Field of the Invention

This invention relates to a washing machine with a rotary drum, fitted with a feed worm that divides the drum into separate zones.

2. Description of the Prior Art

There already exist washing machines which consist of an outer drum divided into separate compartments for washing and rinsing, and a perforated inner drum dipping into the liquid contained in the outer drum.

Separation of the zones of treatment is not complete in such washing machines.

An object of the present invention is to eliminate at least partially the drawbacks of prior machines and to improve upon existing washing machines.

SUMMARY OF THE INVENTION

According to the present invention there is provided in a washing machine an external rotary drum casing, a continuous helical feed worm within and rigid with the casing, and a tubular, drum and worm support shaft having apertures therein for the delivery of fluids to the interior of the drum, said worm serving to divide the interior of the drum casing into a continuous helical compartment divided into a plurality of zones.

According to another feature perforations may be provided at suitable points in the turns of the feed worm.

The feed worm divides the washing drum into any desired number of separate zones of treatment, although the compartment of helical shape is, in fact, continuous. The washing process is carried out by imparting to the drum rotary motion in opposite senses. To discharge the articles of laundry, on the other hand, the drum is turned in a single sense of rotation, along with the feed worm joined to it.

DESCRIPTION OF THE PREFERRED EMBODIMENT

Figure 1:
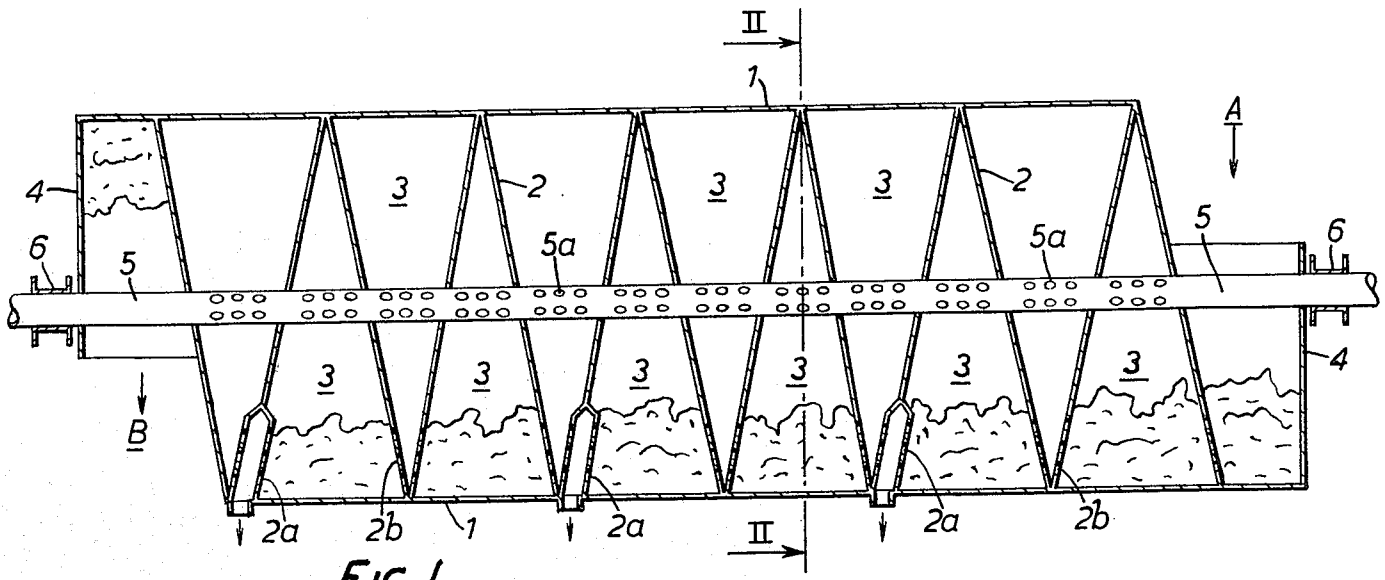
FIG. 1 is a longitudinal section through a washing machine in accordance with the invention.
Figure 2:
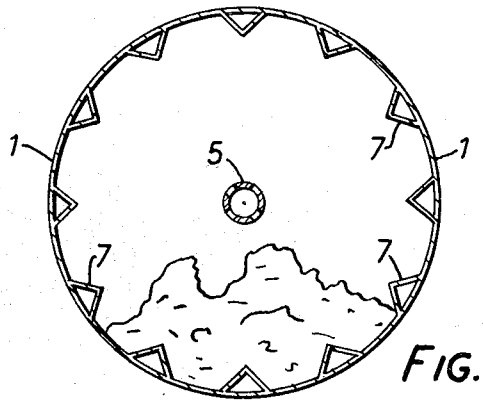
FIG. 2 is a section on the line II—II in FIG. 1.

The washing drum casing 1, accommodates a feed worm 2, rigid with the casing by, for example, continuous welding so that the joint thus formed is watertight. The feed worm 2 divides the washing drum into separate zones of treatment 3, for instance, washing and rinsing compartments. At both ends of the washing drum are semi-circular caps 4.

Through a tubular drum support shaft 5, water, suds, steam and the like can be selectively fed into the washing drum, for which purpose holes, 5*a*, for example, are provided in the drum shaft 5. This shaft 5, which is journalled in bearings 6, also is rigid with the feed worm 2.

Certain turns of the feed worm 2 may be provided optionally with perforations, 2*a* and 2*b*, through which the water or suds can be discharged or passed from one compartment to another. This purpose can also be achieved in other ways. Thus, for instance, transfer pipes may be provided to interconnect pairs of zones or compartments, enabling the liquid to flow from one compartment to the other.

Ribs 7, fitted to the interior face of the casing 1, serve to entrain the contents of the drum as it rotates.

The mode of operation of the washing machine is as follows:

The soiled linen or other articles are placed in the washing drum at A. Water, suds, steam and the like are fed to the various zones 3, through the shaft 5.

The washing and rinsing are carried out by imparting rotary oscillatory motion to the washing drum. In this way, the articles of laundry are perfectly cleaned by the resultant falling and tumbling action.

The articles are fed forward through the drum by continuous rotation of the latter in one sense.

The various rotary movements of the washing drum can readily be combined in an appropriate manner.

I claim:

1. In a washing machine an external rotary drum casing, a feed worm within and rigid with the casing, and a tubular, drum support, shaft having apertures therein for the delivery of fluids to the interior of the drum, said worm serving to divide the interior of the drum casing into a continuous helical compartment.

2. A washing machine according to claim 1, wherein the join of the feed worm and the drum casing is watertight.

3. A washing machine according to claim 1, in which the feed worm is secured to the drum support shaft.

4. A washing machine according to claim 1, in which perforations are provided in the feed worm.

* * * * *